US006401989B1

(12) United States Patent
Grittmann

(10) Patent No.: US 6,401,989 B1
(45) Date of Patent: Jun. 11, 2002

(54) STOWABLE SPIGOT

(76) Inventor: Guenter Grittmann, Ringstrasse 6, D-75031, Eppingen-Muehlbach (DE)

( * ) Notice: Subject to any disclaimer, the term of this patent is extended or adjusted under 35 U.S.C. 154(b) by 0 days.

(21) Appl. No.: 09/744,591

(22) PCT Filed: Jul. 19, 1999

(86) PCT No.: PCT/EP99/05125

§ 371 (c)(1),
(2), (4) Date: Jan. 26, 2001

(87) PCT Pub. No.: WO00/07927

PCT Pub. Date: Feb. 17, 2000

(30) Foreign Application Priority Data

Aug. 6, 1998 (DE) ..... 198 35 569

(51) Int. Cl.[7] ..... B67D 3/00

(52) U.S. Cl. ..... 222/538; 222/523; 222/553; 222/518; 222/532; 251/351

(58) Field of Search ..... 222/538, 522, 222/523, 540, 553, 519, 509, 518, 526, 532, 531, 537; 251/144, 344, 351; 141/360; 137/614.12, 614.19

(56) References Cited

U.S. PATENT DOCUMENTS

| | | | | | |
|---|---|---|---|---|---|
| 1,629,303 | A | * | 5/1927 | Philips | 137/321 |
| 2,138,060 | A | * | 11/1938 | Conner | 222/540 |
| 3,237,818 | A | * | 3/1966 | Bijvoet et al. | 222/566 |
| 3,493,146 | A | * | 2/1970 | Conners et al. | 222/153.06 |
| 4,421,297 | A | * | 12/1983 | Pongrass et al. | 222/553 |
| 4,440,316 | A | * | 4/1984 | Christine | 222/183 |
| 4,469,249 | A | * | 9/1984 | Malpas et al. | 222/83 |
| 4,471,807 | A | | 9/1984 | Lucking et al. | 137/614.19 |
| 4,493,438 | A | * | 1/1985 | Rutter | 222/83 |
| 4,508,234 | A | * | 4/1985 | Bartholomew | 215/206 |
| 4,516,691 | A | * | 5/1985 | Christine et al. | 222/83.5 |
| 4,572,390 | A | | 2/1986 | Grittmann | 217/106 |
| 4,583,650 | A | * | 4/1986 | Bartholomew | 222/522 |
| 4,624,392 | A | * | 11/1986 | Malpas et al. | 222/83 |
| 5,482,190 | A | * | 1/1996 | Stanek et al. | 220/86.1 |
| 6,053,475 | A | | 4/2000 | Batschied | 251/351 |
| 6,260,823 | B1 | * | 7/2001 | Weber | 251/351 |

FOREIGN PATENT DOCUMENTS

| | | |
|---|---|---|
| DE | 1 077 554 | 6/1956 |
| DE | 33 45 619 | 6/1988 |
| DE | 195 40 542 | 5/1997 |
| DE | 297 22 034 | 3/1998 |
| EP | 0 350 243 | 1/1990 |
| GB | 2 138 544 | 10/1984 |

* cited by examiner

*Primary Examiner*—Joseph A. Kaufman
*Assistant Examiner*—Stephanie L. Willatt
(74) *Attorney, Agent, or Firm*—Foley & Lardner

(57) ABSTRACT

Disclosed is a stowable spigot for beverage cans that comprises an outer sleeve with an arrester mechanism for insertion into the opening of a can. The outer sleeve comprises a sliding inner sleeve that supports a gripping member located outside the can. A plug formed at the inner end of the sleeve is sealed with a protection cap located on the outer sleeve. Once the outer sleeve is removed, the protection cap uncovers a channel formed therein. The inner sleeve further includes a push-valve having a drain hole associated therewith. The sleeves are interconnected through a cam and through a curvilinear slot for driving the inner sleeve towards the outside upon rotation of the gripping member. The outer sleeve comprises a draw hole which is located below and is closed by an insert. The draw hold is located adjacent to the abutment, while the insert can be ejected by the cam.

11 Claims, 3 Drawing Sheets

STOWABLE SPIGOT

BACKGROUND OF THE INVENTION

1. Field of the Invention

The present invention relates to a stowable spigot for beverage cans, in particular for beer-containing cans with a volume of, for example, 5 liters.

DE 195 40 542 A1 discloses a liquid container with a stowable emptying spigot which, in the sealed state of the can, is fastened in an opening provided in the vicinity of the base of said can, it being the case that, for draining purposes, the can has air admitted to it and the spigot, which is configured as a sleeve, is drawn out. Once a certain length of the sleeve is located on the outside, this releases a draining opening, with the result that the beverage flows.

2. Description of Related Art

The disadvantage here is that, in order to block the flow, the sleeve has to be pushed into the can interior again, but may slip, with the result that the blocking operation does not take place cleanly. Furthermore, the sleeve may be turned, with the result that the beverage can also flow out, for example, laterally.

Furthermore, the grip which is used for drawing out the sleeve is necessarily in the vicinity of the can wall, with the result that it is difficult to actuate.

Said emptying spigot has an emptying opening configured as a tubular extension, so it is obvious that a complicated process is necessary for installing the spigot. Even when the container is being transported, the liquid is permanently present at the outlet opening, as a result of which the sealing of the device has to meet high requirements. Furthermore, the liquid flows out even when the outlet opening is only partially released.

DE-B 1077554 describes a liquid container with a tubular, displaceably mounted housing part in which a push-valve is arranged.

The disadvantage here is that such a spigot is not suitable, in particular, for use in containers with pressurized liquids since the valve body is driven outward by the internal liquid pressure. This makes the containers more difficult to transport.

A further disadvantage in this context is that the device does not have any covering in relation to the container interior and, since the valve can be actuated in any position of the tubular housing part, even before initial use, unintentional actuation of the valve with the housing part in the drawn-out state results in liquid flowing out immediately. If the valve is actuated unintentionally in the pushed-in state of the housing part, the latter fills with liquid. When it is drawn out, the liquid flows out.

EP 0350 243 A1 discloses a spigot with an end seal for the rear inlet opening by means of a stopper and protective sheath and a rotary movement of the inner sleeve for driving the device out of the container, the device being used in a liquid container which comprises a rigid outer vessel and a flexible inner vessel, and the device being retained at two accommodating points in the front and rear regions of the valve housing.

The spigot itself, rather than being ready for functioning once it has been driven out, still requires a further operating step. The discharge means here are configured such that, following the turning movement for driving out the device, a further turning movement is needed for discharging the liquid, it being necessary for the outlet opening of the discharge means to be made to coincide with the outlet opening of the valve body. Unintentional actuation of the discharge means during the turning movement of the valve body results in the liquid flowing out immediately.

SUMMARY OF THE INVENTION

The object of the present invention is thus to provide a stowable spigot for beverage cans, in particular pressurized containers, which is straightforward to install, has improved handleability, prevents unintentional outflow of liquid and, furthermore, makes it possible for the beverage can to be emptied virtually completely.

BRIEF DESCRIPTION OF THE DRAWINGS

The present invention is explained in more detailed with reference to the attached figures, in which.

Figure 1:
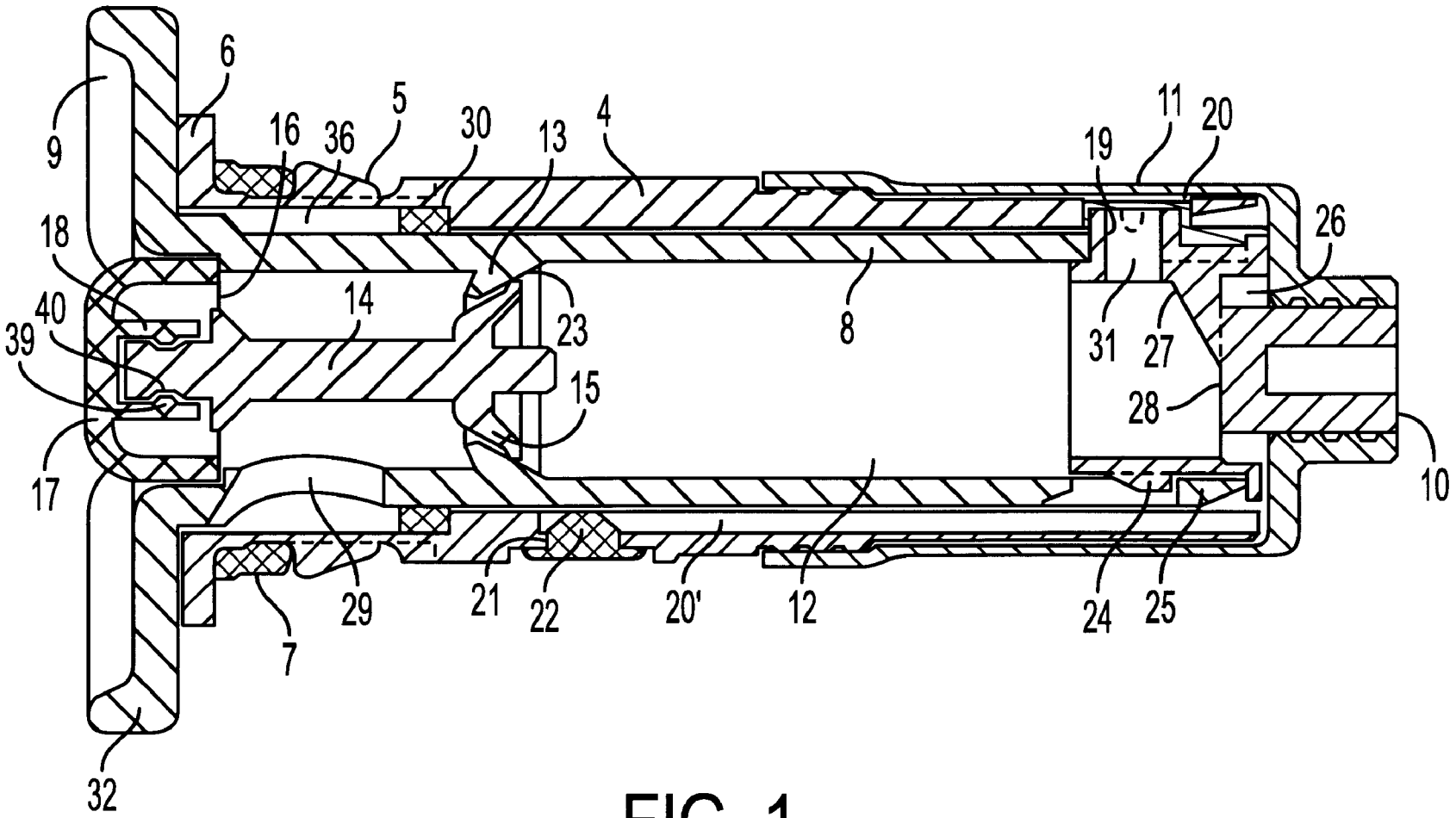
FIG. 1 shows the spigot in the preassembled state, in section.

This object is achieved by a stowable spigot for beverage cans which, in the wall, has holes arranged in the vicinity of the base, having an outer sleeve with a latching mechanism at the outer end for fitting in the can opening, the latching mechanism comprising inner latching wedges, an outer flange and a first, flat sealing ring located therebetween, it being the case that arranged in the interior of the outer sleeve is an inner sleeve which can be displaced against a front stop and bears a grip located on the can exterior, and integrally formed on the inner end of the sleeve is a stopper which, in the state in which the inner sleeve is pushed fully into the outer sleeve, is sealed by a protective sheath which butts against the outer sleeve and, once the inner sleeve has been drawn out, releases a channel located in the interior of said inner sleeve, it being the case that the inner sleeve also has a collar located in the vicinity of its outer end, and arranged coaxially with said collar is a push-valve which engages through said collar and bears a sealing lip which butts against the inside of the collar, and butting against a stop of the inner sleeve, at the outer end of the latter, is a rubber cap which is connected to the push-valve, and the length of the push-valve is selected such that, in the state in which the rubber cap is relieved, or virtually relieved, of stressing, the sealing lip butts against the collar, and the inner sleeve, assigned to the push-valve, bears a draining hole, and it being the case that the inner sleeve and the outer sleeve are connected to one another via a cam and a curved slot, which, when the grip is turned, drives the inner sleeve outward, and the curved slot is arranged in the outer sleeve, and the latter has a bottom emptying bore which is closed by an insert, it being the case that the emptying bore is arranged in the vicinity of the stop and the insert can be ejected by the cam.

The device functions as follows. On delivery of the cans, in particular 5 L beer cans, the inner sleeve is located in the interior in a state in which it is pushed fully into the outer sleeve, which is secured by the flange and the latching wedges in the hole arranged in the vicinity of the can base.

For draining purposes, the inner sleeve is moved against the stop which secures it, it being the case that the stopper integrally formed on said sleeve is freed from the protective sheath which seals the stopper; as a result of this, the path to the inner channel is freed and the beverage is present at the sealing lip of the push-valve and/or at the collar.

If the rubber cap is then pushed inward, the push-valve connected to it moves the sealing lip into the channel, the sealing lip is raised off from the collar and the beverage can flow out via the draining hole, it being possible for the sleeves to be guided on one another, with the result that, during the draining operation, the draining hole is inevitably located at the bottom. Once the rubber cap has been released of loading, it draws the push-valve back, and the sealing lip positions itself on the collar, as a result of which the flow of beverage is interrupted. Following the draining operation, the spigot may remain in the drawn-out position. The length of the push-valve and the elasticity of the rubber cap are coordinated with one another such that the lip is easily drawn against the collar, with the result that the seal is reliable even when, in the virtually empty state, the hydrostatic pressure is low. As an equivalent, of course, it is also possible for the rubber cap to be replaced by a spring-loaded button, it being possible for the spring to be supported, for example, on the collar.

The rubber cap itself is advantageously connected to the push-valve end via a narrowing of the same, for which purpose a bushing with a bead is integrally formed on the center of the rubber cap, with the result that all that is required for installation is for this to be clipped on.

The interspace between the sleeves is sealed by the protective sheath, the internal can pressure enhancing the seal. It is additionally proposed to fit a further seal between the sleeves at the front end of the sleeves, in the vicinity of the can wall, said further seal sealing the gap between the sleeves once the inner sleeve has been drawn out. In this case, the gap between the sleeves at the front end may be enlarged, with the result that the outer sleeve can spring into this region here upon installation of the previously assembled spigot.

The sleeves are connected via a cam and a curved slot which interacts with said cam. Since the outer sleeve is clamped in the base opening of the can in a rotationally fixed manner, turning of the inner sleeve inevitably causes advancement in the outward direction. This advancement is approximately 2 cm in length. The results of this are as follows. It may be difficult to grip behind the grip on the inner sleeve, said grip being located in the vicinity of the can wall so that it is secured during transportation, in order for it to be possible to take hold of the grip securely and pull it. A turning movement, on the other hand, is easy to carry out. If the inner sleeve is thus turned, by means of its grip, through, in particular, an angle of 90°, the grip may be moved out of a vertical position into a horizontal position and, at the same time, moved away from the can wall to such an extent that it can easily be gripped in order for the inner sleeve to be drawn out fully. For the sake of convenience, the grip here comprises two wings, behind which it is possible to grip using the index finger and middle finger and which serve as an abutment for actuation of the rubber cap using the thumb.

The curved slot is located in the outer sleeve and the cam is thus located on the inner sleeve, which, on the one hand, facilitates installation and, on the other hand, thus also makes it possible for an insert which is fitted in the outer sleeve at the bottom in front of the stop to be ejected by the cam and thus for an emptying bore to be released, with the result that residual liquid can be discharged via said bore by virtue of the can being tilted. The cam advantageously has itself a central through-passage, via which the emptying bore can be connected to the channel.

The protective sheath is drawn over the outer sleeve to such an extent that it is able to cover the curved slot where the latter passes through the sleeve. The stopper of the inner sleeve is sealed here via a correspondingly tapered bead of the sheath.

Furthermore, the cam and the stopper advantageously form part of a separate insert which, once the inner sleeve has been preassembled in the outer sleeve, can be inserted into corresponding recesses from the rear ends of said sleeves. The insert may be guided on insert and inner sleeve via a pair of carry-along elements.

The stopper is connected to the insert in this case via noses, and said insert is adjoined by an annular space via which it is possible to produce the connection to the channel.

The grip, furthermore, preferably has a plate on which the wings are integrally formed. This plate may have an opening and be fitted, via the latter, a tamperproof securing means between can and plate [sic], said securing means being destroyed when the wings are turned.

Figure 2:
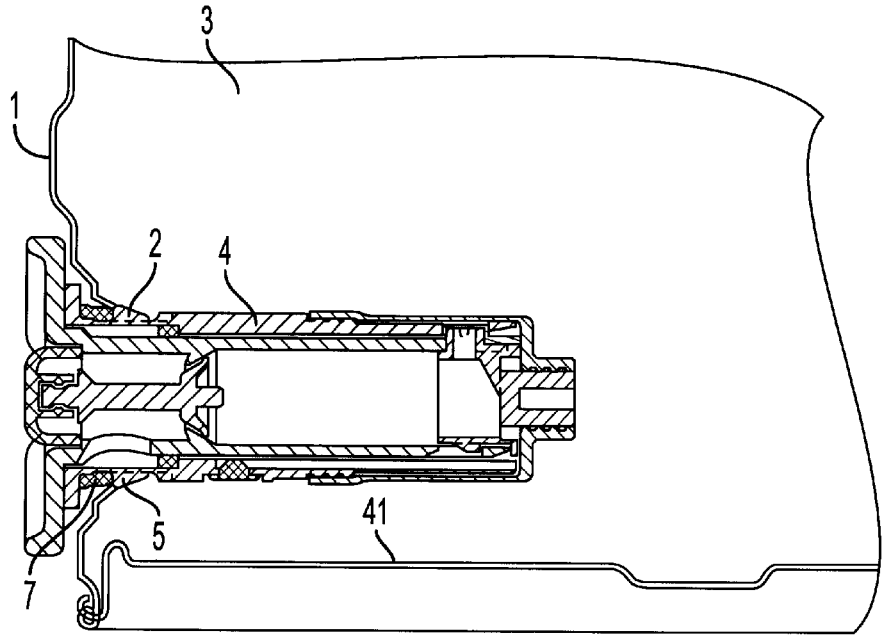
FIG. 2 shows said spigot in the installed state, in section.
Figure 3:
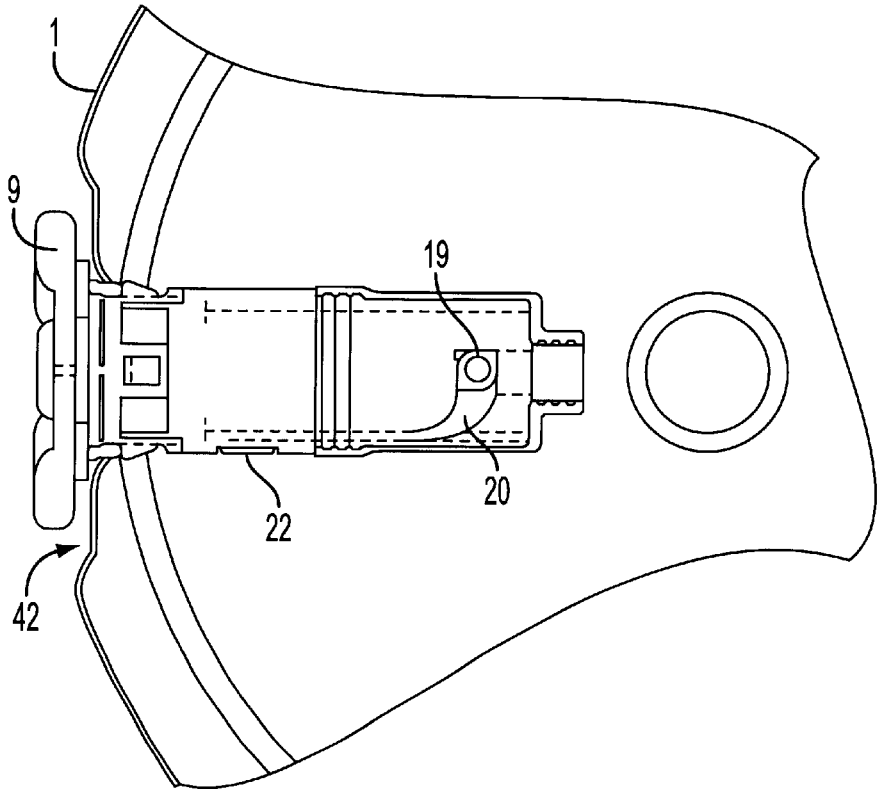
FIG. 3 shows the curved-slot guide.

The present invention is explained in more detail with reference to the attached figures, in which:

FIG. 1 shows the spigot in the preassembled state, in section,

FIG. 2 shows said spigot in the installed state, in section,

FIG. 3 shows the curved-slot guide, and

Figure 4:
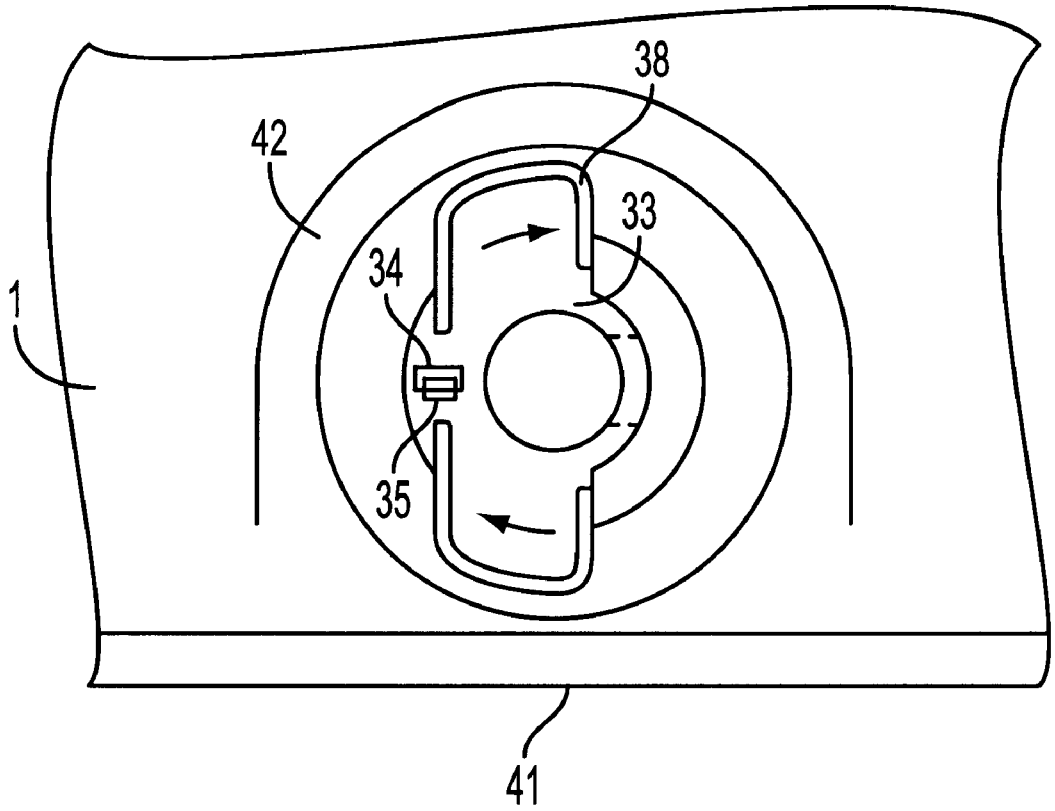
FIG. 4 shows a plan view of the slot.

FIG. 4 shows a plan view of the slot.

Turning now to the drawings, FIG. 1 shows, in longitudinal section, the outer sleeve 4, which, for securing in the can wall, has a front flange 6, and, adjoining this, the first sealing ring 7 and, behind the latter, separate latching wedges 5 which are distributed over the circumference, snap in behind the can wall and secure the sleeve 4 on the latter. Beneath the latching wedges, the inner sleeve has a widening 36 into which said latching wedges can spring at the final installation stage. The second sealing ring 30 is located in said widening.

The protective sheath 11 is drawn around that end of the outer sleeve 4 which is located in the inside of the can.

The protective sheath 11 covers over the curved slot 20, which is formed on the end side, is open in the outward direction here and continues at the bottom chord of the sleeve 4, within the sleeve wall 37, as a continuation of a 90°-curve guide in a rectilinear manner as far as the end stop 41, against which the cam 19 of the inner sleeve 8 can be positioned.

Said inner sleeve 8 is illustrated in the state in which it is pushed into the outer sleeve 4. It exhibits the grip 9 with the wings 38 projecting therefrom. On the inside, the inner sleeve 8 has a flank 16 in the form of the annular step, against which the rubber cap 17 is supported. Said rubber cap 17 has a centrally arranged bushing 18 which engages around the outer (left-hand) end of the push-valve 14. By means of the bushing, the rubber cap is connected to the push valve (14) (clipped on) via an annular bead 39 and an annular groove 40.

Beneath the push-valve 14, the draining hole 29 is protected by the outer sleeve in the pushed-in state.

The inner sleeve 8 also has a conically running collar 13 against which, in the blocking state, the sealing lip 15 of the push-valve 14 butts, said sealing lip being drawn against said push-valve by the elasticity of the rubber cap 17.

The insert 28 is introduced into the inner end via corresponding through-passages, said insert bearing the cam 19, which is illustrated here as being turned upward through 90°. The insert 28 and inner sleeve 8 have one or more pairs of carry-along elements 24; 25 for force-transmission purposes.

The insert 28 also has noses 27 integrally formed on it, said noses bearing the stopper 10, over which the corresponding taper of the protective sheath 11 is drawn. Located in front of the noses is the annular space 26, which connects the can interior to the channel 12. The can interior can be emptied through the draining opening 29 once the valve, comprising resilient sealing lip 15 and collar 13, has been opened.

As explained above, turning the grip 9 causes, via the curved slot 20 and the cam 19, the inner sleeve 8 to be driven out until the grip has been turned through 90°. In this case, the cam 19 is guided in a rotationally fixed manner in the slot continuation 20' with the result that the inner sleeve can only be drawn out once the 90° position has been reached. Before reaching the end position, i.e. the cam 19 butting against front end of the slot 20', the cam 19 reaches the inwardly convexly formed insert 22 in the emptying bore 21 and drives it out into the can interior, with the result that them residues can be emptied from the can via said bore and the through-passage 31.

FIG. 2 illustrates the fixing of the spigot in the can wall 1 of a 5 L beer can. The latter has a hole 2 in the vicinity of its base 41. The spigot is pushed through the hole 2, the hole 2 being narrowed inward and sliding over the outer sleeve 4 during the pushing-in operation. The latching wedges 5 snap behind the hole 2 and the first sealing ring 7 between the flange 6 and latching wedges 5 is pinched by the hole 2, with the result that it withstands the internal pressure of the can.

FIG. 3 shows a plan view of the 90° curved slot 20 in which the cam 19 slides and, when the grip 9 is turned, drives the inner sleeve out of the outer sleeve 4.

The cam 19 and insert 22 are depicted here as being turned through 90° relative to the base 41.

The hole 2 is located within a narrowing 42 of the can wall 1, which accommodates and protects the grip 9.

FIG. 4, finally, shows the spigot, fitted in the can wall 1, with the narrowing 42 from the front. It is possible to see a plate 33 in the vicinity of the can base 41, the wings 38, which are located vertically in the transporting state of the can, being integrally formed on said plate. An opening which serves for fastening a tamperproof securing means 35 is provided in the plate 33.

List of designations

| | | | |
|---|---|---|---|
| 1 | Wall | 22 | Insert |
| 2 | Holes | 23 | Stop |
| 3 | Beverage cans | 24 | Carry-along element |
| 4 | Outer sleeve | 25 | Carry-along element |
| 5 | Latching wedges | 26 | Annular space |
| 6 | Flange | 27 | Noses |
| 7 | First sealing ring | 28 | Insert |
| 8 | Inner sleeve | 29 | Draining hole |
| 9 | Grip | 30 | Second sealing ring |
| 10 | Stopper | 31 | Through-passage |
| 11 | Protective sheath | 32 | Wings |
| 12 | Channel | 33 | Plate |
| 13 | Collar | 34 | Opening |
| 14 | Push-valve | 35 | Tamperproof securing means |
| 15 | Sealing lip | 36 | Widening |
| 16 | Flank | 37 | Sleeve wall |
| 17 | Rubber cap | 38 | Wings |
| 18 | Bushing | 39 | Annular bead |
| 19 | Cam | 40 | Annular groove |
| 20,20' | Curved slot | 41 | Base |
| 21 | Emptying bore | 42 | Narrowing |

What is claimed is:

1. A stowable spigot for a beverage container which beverage container comprises a wall having an opening therethrough wherein said opening is arranged in the vicinity of a base of said wall, said stowable spigot comprising:

(a) an outer sleeve;

(b) a latching mechanism arranged at an outer end of said outer sleeve for securing said outer sleeve to said wall, said latching mechanism comprising:
  (i) an inner latching wedge;
  (ii) an outer flange; and
  (iii) a first, flat sealing ring arranged between said inner latching wedge and said outer flange (c) a front stop;

(d) a grip located on an exterior of said container;

(e) an inner sleeve, comprising an interior, an inner end and an outer end, and
  (i) arranged in an interior of said outer sleeve; and
  (ii) capable of being displaced against said front stop and bearing said grip;

(f) a protective sheath;

(g) a channel located in said interior of said inner sleeve;

(h) a stopper integrally formed on said inner end of said inner sleeve and arranged such that, in a condition in which said inner sleeve is pushed fully into said outer sleeve, said inner sleeve is sealed by said protective sheath which butts against said outer sleeve and, in a condition in which said inner sleeve has been drawn out, said channel is exposed;

(i) a collar located in the vicinity of said outer end of said inner sleeve;

(j) a sealing lip;

(k) a stop;

(l) a push-valve, arranged coaxially with said collar, wherein said push valve engages through said collar and bears said sealing lip which buts against an inside of said collar.

(m) a rubber cap butting against said inner sleeve, at said outer end of said inner sleeve, wherein said inner sleeve is connected to said push-valve, and the length of said push-valve is selected such that, in a condition in which said rubber cap is unstressed or virtually unstressed, said sealing lip butts against said collar;

(n) a draining hole in said inner sleeve;

(o) a cam arranged to connect said inner sleeve and said outer sleeve to one another;

(p) a curved slot, which drives said inner sleeve outward, when said grip is turned and which is arranged in said outer sleeve, (q) an insert;

(r) a bottom emptying bore in said outer sleeve which is closed by said insert wherein said emptying bore is arranged in the vicinity of said stop and said insert can be ejected by said cam.

2. A spigot according to claim 1, wherein said cam comprises a through-passage via which said bottom emptying bore is in fluid communication with said channel of said inner sleeve.

3. A spigot according to claim 1, wherein said rubber cap is latched to said push-valve via a centrally arranged bushing.

4. A spigot according to claim 1, further comprising a second sealing ring positioned between said outer sleeve and said inner sleeve.

5. A spigot according to claim 1, wherein said curved slot comprises a turning angle of 90° and, thereafter, runs coaxially with said sleeves.

6. A spigot according to claim 1, wherein said protective sheath is arranged over said outer sleeve and over said stopper, said sheath terminating approximately flush with said stopper such that access to said channel from an interior of said beverage container is provided when said inner sleeve is drawn out.

7. A spigot according to claim 1, wherein said cam and said stopper are arranged in said inner sleeve on an insert.

8. A spigot according to claim 1, further comprising an annular space arranged around said stopper and connected to said channel.

9. A spigot according to claim 1, wherein said stopper is connected to the inner sleeve and/or said insert via spaced-apart noses.

10. A spigot according to claim 1, wherein said grip comprises wings arranged to lie across from one another and which are integrally formed on a plate connected to said inner sleeve, wherein each of said wings is arranged in a vertical position in the fully pushed-in state of said inner sleeve and is arranged in a horizontal position once said sleeve has been drawn out.

11. A spigot according to claim 10, wherein said plate comprises an opening on which a tamperproof securing means can be fastened.

* * * * *